US005078288A

United States Patent [19]

Fuchs

[11] Patent Number: 5,078,288

[45] Date of Patent: Jan. 7, 1992

[54] CHILD RESISTANT SPOUT PACKAGE

[75] Inventor: Timothy J. Fuchs, Perrysburg, Ohio

[73] Assignee: Owens-Illinois Closure Inc., Toledo, Ohio

[21] Appl. No.: 605,616

[22] Filed: Oct. 30, 1990

[51] Int. Cl.[5] ..... B65D 50/08; B65D 55/02

[52] U.S. Cl. ..... 215/209; 215/216; 215/218; 222/572

[58] Field of Search ..... 215/209, 218, 221, 213, 215/216; 222/566, 567, 568, 569, 570, 572

[56] References Cited

U.S. PATENT DOCUMENTS

| | | | |
|---|---|---|---|
| 3,360,147 | 12/1967 | Schaefer | 215/209 |
| 3,881,624 | 5/1975 | Dougherty, Sr. | 215/221 |
| 4,117,945 | 10/1978 | Mumford | 215/216 |
| 4,172,533 | 10/1979 | Montgomery | 215/216 |
| 4,351,442 | 9/1982 | Summers | 215/216 |
| 4,383,618 | 5/1983 | Dougherty | 215/216 |
| 4,436,211 | 5/1984 | Gach | 215/216 |
| 4,550,862 | 11/1985 | Barker et al. | 222/568 |
| 4,640,855 | 2/1987 | St. Clair | 222/566 |

*Primary Examiner*—Stephen Marcus
*Assistant Examiner*—Paul Schwarz

[57] ABSTRACT

A child resistant spout package wherein a plastic container includes a neck and a spout extending axially outwardly through said neck and the neck includes internal threads that are engaged by external threads on a closure which projects beyond the finish to accommodate the spout. The finish of the container includes an axially extending flexible wall. Interengaging ratchets are provided between a flange on the closure and the flexible wall of a container and are operable to normally permit rotation of the closure to apply the closure to the container but prevent rotation of the closure for removing the closure from the container. When the flexible wall is flexed at points spaced from the ratchet, the wall is deformed sufficiently to prevent the ratchet on the wall and the closure from engaging so that the closure can be rotated to remove the closure from the container.

5 Claims, 2 Drawing Sheets

CHILD RESISTANT SPOUT PACKAGE

This invention relates to spout packages.

BACKGROUND AND SUMMARY OF THE INVENTION

One type of commonly provided package such as shown in U.S. Pat. No. 4,640,855, 4,671,421, 4,706,829 and 4,890,768, comprises a plastic container having a neck or finish with internal threads and an integral or separate spout that extends axially outwardly through the neck together with a closure that has external threads engaging the internal threads of the finish and having a portion extending above the finish to accommodate the spout.

As far as is known, such packages have not been child resistant.

Accordingly, among the objectives of the present invention are to provide a child resistant spout package; which can be readily provided on a spout package; which is relatively low in cost and simple in design.

In accordance with the invention, a child resistant spout package wherein a plastic container includes a neck and a spout extending axially outwardly through said neck and the neck includes internal threads that are engaged by external threads on a closure which projects beyond the finish to accommodate the spout. The finish of the container includes an axially extending flexible wall. Interengaging ratchets are provided between a flange on the closure and the flexible wall of a container and are operable to normally permit rotation of the closure to apply the closure to the container but prevent rotation of the closure for removing the closure from the container. When the flexible wall is flexed at points spaced from the ratchet, the wall is deformed sufficiently to prevent the ratchet on the wall and the closure from engaging so that the closure can be rotated to remove the closure from the container.

DESCRIPTION

Figure 1:
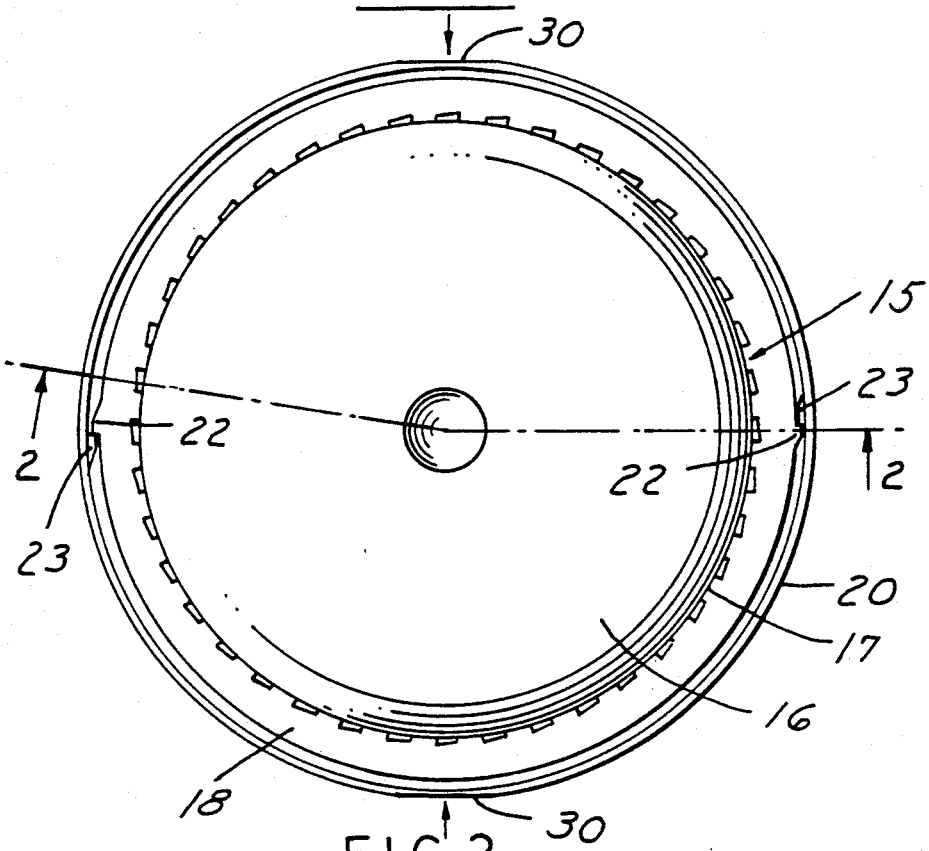
FIG. 1 is an enlarged plan view of a child resistant spout package embodying the invention.
Figure 2:
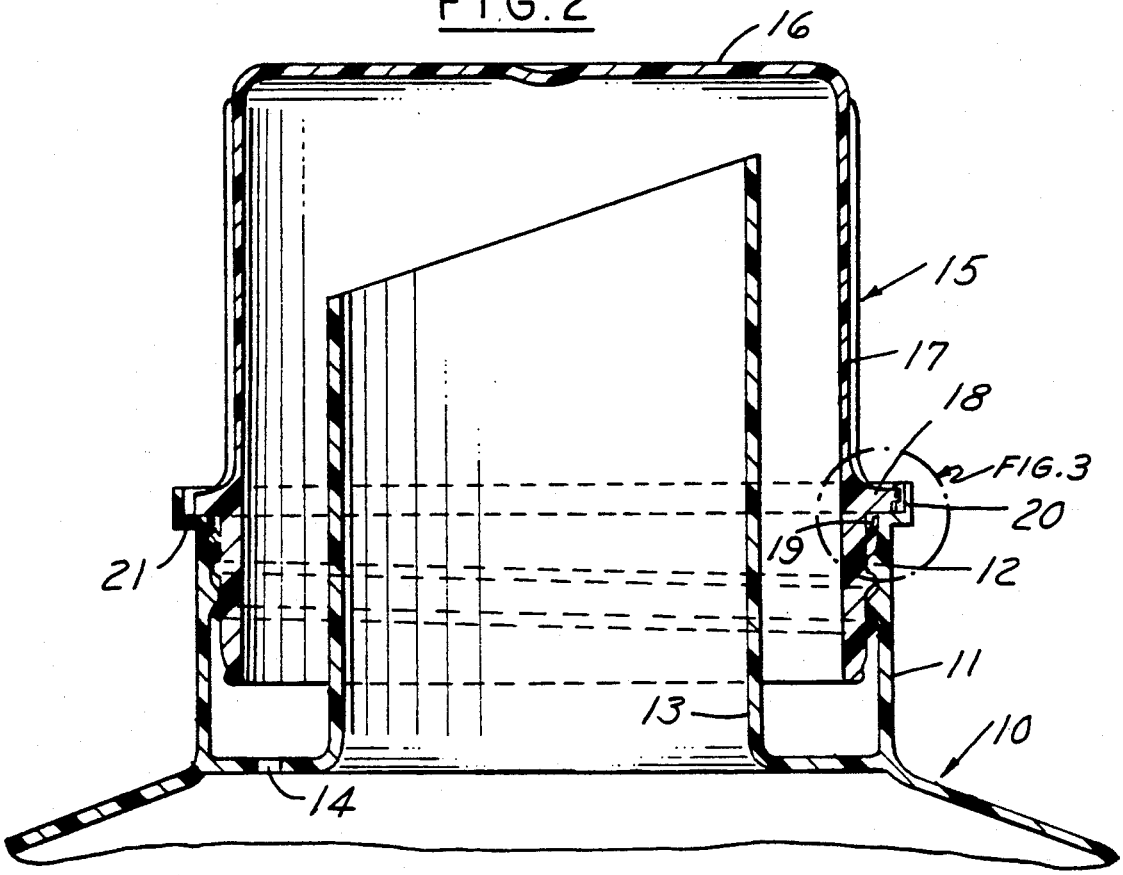
FIG. 2 is a fragmentary sectional view taken along the line 2—2 in FIG. 1.
Figure 3:
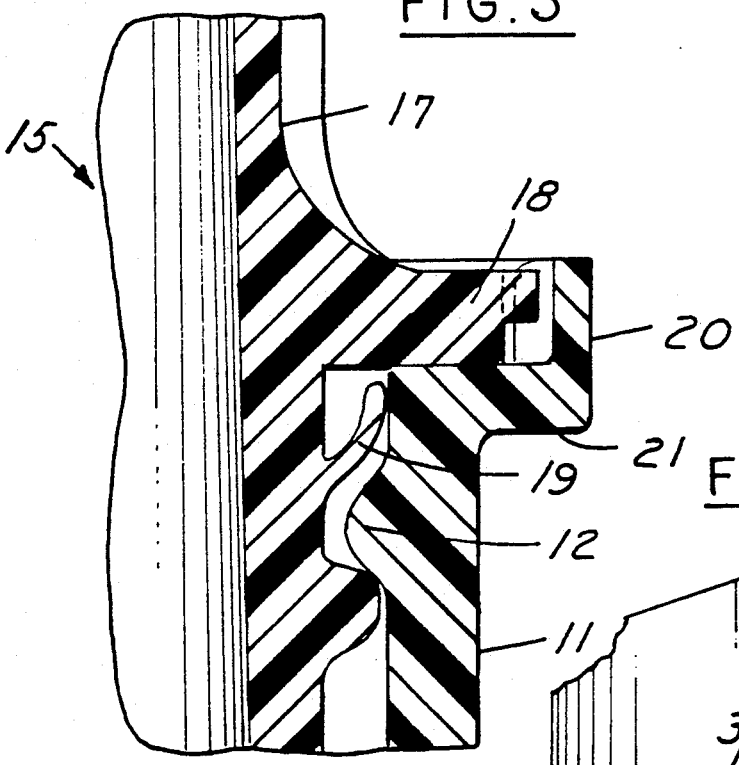
FIG. 3 is a fragmentary sectional view on an enlarged scale of a portion of the package shown in FIG. 2.
Figure 5:
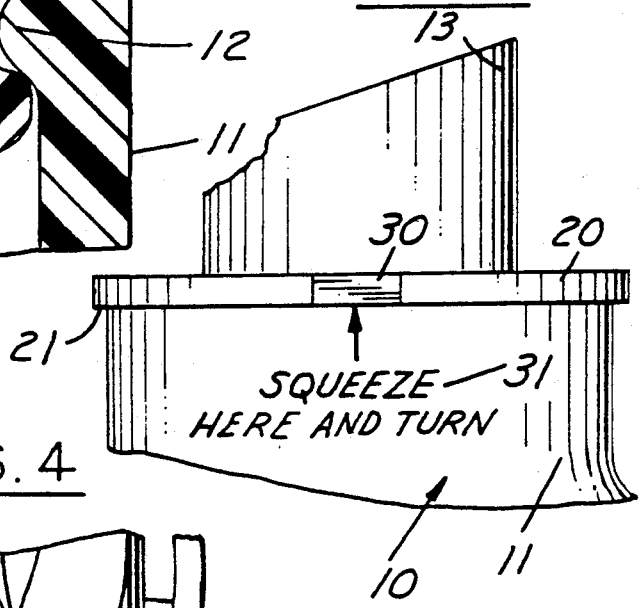
FIG. 5 is a fragmentary elevational view.
Figure 4:
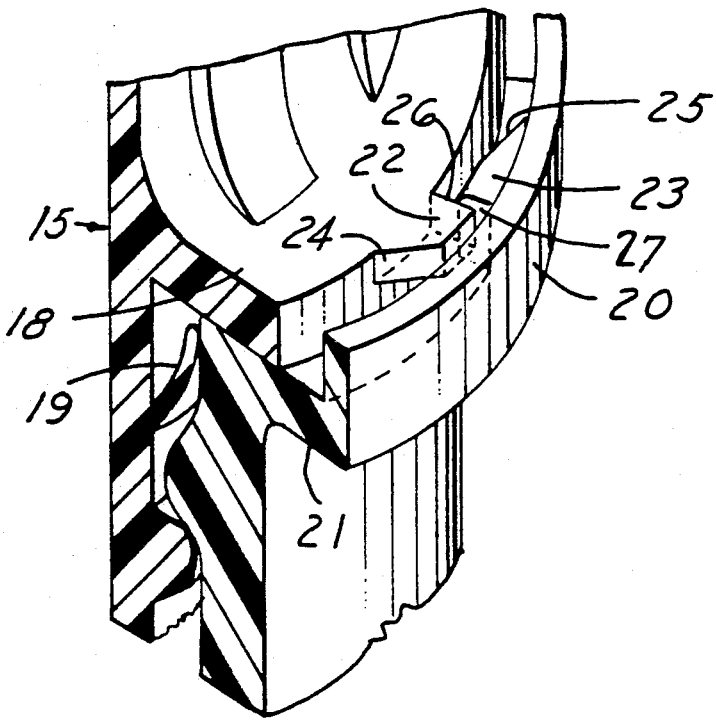
FIG. 4 is a fragmentary perspective view of the portion of the package shown in FIG. 3.

Referring to FIGS. 1 and 2, the invention relates to a package comprising a plastic container 10 including a neck or finish 11 having internal threads 12 and a spout 13, herein shown as an integral spout, extending axially outwardly through the finish 11 and projecting beyond the finish. In accordance with conventional construction, the container includes a drainback opening 14 for permitting liquid to drain back into the container. The package further includes a closure 15 including a base wall 16 and a peripheral skirt 17 with an integral radial flange 18 adapted to engage the upper end of the finish 11, as well as appropriate seal such as an integral lip 19 engaging the inner surface of the wall of the finish 11.

In accordance with the invention, ratchet means are provided between an integral annular peripheral flexible wall 20 that extends axially outwardly from a radial flange 21 on the finish 11 and ratchet means on the radial flange 18 of the closure 15. As shown in FIGS. 1–4, the ratchet means comprises diametrically opposed ratchet teeth 22 on the flange 18 of the closure and teeth 23 on the flexible wall 20 of the finish. Each tooth 22 includes an inclined ramp 24. Each tooth 23 includes an inclined ramp 25 such that when the closure is rotated in a direction to apply the closure to the container, the teeth ratchet over one another, but when the closure is rotated in the opposite direction, abutting surfaces 26, 27 prevent the closure from being rotated.

When it is desired to remove the closure, the flexible wall 20 is grasped in the direction of the arrows as shown in FIG. 1 to flex the wall so that the teeth 23 are moved out of engagement with the teeth 22 permitting the closure to be rotated.

In order to facilitate grasping and squeezing, recesses 30 may be provided on the exterior of the flexible wall 20 and indicia 31 may be provided on the outer wall 31 to indicate when the wall 20 should be squeezed.

It can thus be seen that there has been provided a child resistant spout package wherein a plastic container includes a neck and a spout extending axially outwardly through said neck and the neck includes internal threads that are engaged by external threads on a closure which projects beyond the finish to accommodate the spout. The finish of the container includes an axially extending flexible wall. Interengaging ratchets are provided between a flange on the closure and the flexible wall of a container and are operable to normally permit rotation of the closure to apply the closure to the container but prevent rotation of the closure for removing the closure from the container. When the flexible wall is flexed at points spaced from the ratchet, the wall is deformed sufficiently to prevent the ratchet on the wall and the closure from engaging so that the closure can be rotated to remove the closure from the container.

I claim:

1. A package comprising:

a plastic container having a finish with internal threads, a closure having external threads engaging the internal threads of the container, said closure having a substantial portion thereof extending beyond said finish, an integral radial flange intermediate the axial ends of the closure extending radially outwardly from said closure, said finish including an integral radial flange extending outwardly from said finish, said radial flange on said closure engaging said radial flange on said finish when said closure is threaded on said finish, said radial flange on said finish extending radially outwardly beyond said radial flange on said closure, an integral axial flexible wall extending axially outwardly form said radial flange on said finish, and interengaging ratchet means between said integral flexible axial wall on said finish and said radial flange on said closure operable to permit rotation of said closure for applying said closure to the container but normally preventing rotation of said closure for removal of said closure, said flexible wall on said finish being sufficiently flexible such that when it is flexed at circumferentially spaced points spaced from said ratchet means, said ratchet means on said flexible wall of said finish are moved radially outwardly out of engagement with said ratchet means on the radial flange on said closure permitting said closure to be rotated for removing said closure from said container.

2. The package set forth in claim 1 wherein said ratchet means comprise ratchet teeth, each of said teeth having an inclined surface for permitting rotation to apply said closure and an abutment surface for preventing rotation for removing the closure.

3. The package set forth in claim 2 wherein said teeth are on the flexible wall of said finish and said abutment in on said radial wall of said radial flange of said closure.

4. The package set forth in claim 3 including indicia on said flexible wall spaced from said ratchet means to indicate where the wall should be flexed.

5. The package set forth in any one of claim 1–4 including spout means on said container extending axially outwardly within said closure.

* * * * *